US006543563B1

(12) United States Patent
Muraro

(10) Patent No.: US 6,543,563 B1
(45) Date of Patent: Apr. 8, 2003

(54) CAB FOR EARTH-MOVING MACHINES

(75) Inventor: Umberto Muraro, Noventa Vicentina (IT)

(73) Assignee: Komatsu Utility Europe S.p.A., Noventa Vicentina (IT)

( * ) Notice: Subject to any disclaimer, the term of this patent is extended or adjusted under 35 U.S.C. 154(b) by 0 days.

(21) Appl. No.: 09/691,856

(22) Filed: Oct. 18, 2000

(51) Int. Cl.[7] ..... B62D 33/073; B62D 33/067

(52) U.S. Cl. ..... 180/89.12; 180/89.14; 296/190.05; 296/190.06

(58) Field of Search ..... 296/35.1, 190.01, 296/190.05, 190.06; 180/89.12, 89.13, 89.14, 89.15; 414/918, 685, 686; 285/124.1, 124.4, 124.5, 222.1

(56) References Cited

U.S. PATENT DOCUMENTS

| | | | | | |
|---|---|---|---|---|---|
| 3,990,737 | A | * | 11/1976 | Palmer | 296/188 |
| 4,014,588 | A | * | 3/1977 | Kohriyama | 267/141.4 |
| 4,046,399 | A | * | 9/1977 | Zeuner et al. | 172/316 |
| 4,150,474 | A | | 4/1979 | Bauer et al. | |
| 4,409,672 | A | | 10/1983 | Takemae | |
| 4,483,084 | A | * | 11/1984 | Caldwell et al. | 37/348 |
| 4,570,425 | A | * | 2/1986 | Carr | 56/11.9 |
| 5,060,742 | A | * | 10/1991 | Kuhlmann et al. | 180/89.14 |
| 5,150,942 | A | * | 9/1992 | Fujan et al. | 180/89.14 |
| 5,299,857 | A | * | 4/1994 | Zanetis | 111/101 |
| 5,316,347 | A | * | 5/1994 | Arosio | 285/124.4 |
| 5,388,884 | A | * | 2/1995 | Keehner et al. | 296/190.03 |
| 5,520,500 | A | | 5/1996 | McIlwain et al. | |
| 5,551,826 | A | | 9/1996 | Todd et al. | |
| 5,832,705 | A | * | 11/1998 | Eis et al. | 56/14.9 |
| 5,941,330 | A | * | 8/1999 | Miller et al. | 180/328 |
| 5,984,036 | A | * | 11/1999 | Higuchi et al. | 180/89.12 |
| 6,030,169 | A | * | 2/2000 | Rossow et al. | 180/273 |

FOREIGN PATENT DOCUMENTS

JP 6-144793 A * 5/1994

* cited by examiner

*Primary Examiner*—Paul N. Dickson
*Assistant Examiner*—Ruth Ilan
(74) *Attorney, Agent, or Firm*—Browdy and Neimark, P.L.L.C.

(57) ABSTRACT

A cab for earth-moving machines is constituted by a support structure within which a control station for an operator is obtained. A hinging element and a locking element permit the fastening of the support structure to a frame of an earth-moving machine. Control levers are positioned within the support structure in correspondence with the control station for controlling operative organs of the earth-moving machine. A plurality of hydraulic conduits are connected to the control levers and a plurality of semi-couplings are connected to at least a portion of the plurality of hydraulic conduits and are able to be coupled to a corresponding plurality of semi-couplings connected to a hydraulic system of the earth-moving machine.

10 Claims, 4 Drawing Sheets

CAB FOR EARTH-MOVING MACHINES

TECHNICAL FIELD OF THE INVENTION

BACKGROUND OF THE INVENTION

The present invention relates to a cab for earth-moving machines.

Hereafter, reference shall be made in particular to earth-moving machines of the category known in the art with the name of skid steer loader, whereto the subject invention is preferably destined, although it is applicable in general to all categories of earth-moving machines.

PRIOR ART

Earth-moving machines are composed of a frame mounted on four wheels, of at least an articulated arm fastened to the frame and bearing a work tool, and of a cab for housing an operator, mounted on the frame. Alternatively, the frame can be equipped with tracks instead of wheels.

Earth-moving machines further comprise a motorized driving system and an arm actuation system. Each machine is also provided with an electrical system.

Typically, the machine is activated by an operator housed in the cab, who acts on two control levers, or other equivalent organs, positioned one to the right and the other to the left of the operator, and connected one to the driving system and the other to the arm actuation system.

The driving system and the arm actuation system are constituted by two hydraulic servo control loops, each comprising at least a pump driven by the engine and a plurality of conduits and valves; each loop is connected between a control lever and the related activated organ.

In accordance with the prior art, the cabs comprise a support structure in which is defined a compartment provided with a seat for the operator.

Other cabs are fitted with doors and/or windows mounted to close the support structure, in order to isolate the operator from the external environment.

In the lower portion of the structure are also provided openings able to allow the operator to move the control levers mounted on the frame.

These cabs are typically mounted in correspondence with the front portion of the frame, where the control levers are installed, so that the levers themselves are in the correct position.

The cab can be mounted on the frame or rigidly or, as taught for instance by U.S. Pat. Nos. 5,520,500, 5,551,826 and 4,409,672, by means of a pivoting joint which allows to tilt the cab either in the forward or backward direction.

In the case of pivotal mounting, locking points must also be provided to prevent the possibility that the cab may be tilted when it is in operative condition.

In the traditional constructive form, all operative organs of the machine are mounted directly on the frame.

These operative organs include the control organs, the articulated arm bearing the working tool, the engine and the hydraulic and electrical systems that connect the control organs to the engine and to the articulated arm.

In traditional solutions, therefore, no part of the operative organs extends into the cab, as the latter is mounted on the frame in correspondence with the position in which the control organs are located.

U.S. Pat. Nos. 5,520,500 and 5,551,826 instead provide a different solution from the traditional one, in that the articulated arm is fastened not to the frame, but to the side walls of the cab which must therefore be load bearing and suitably dimensioned.

This solution consequently requires part of the hydraulic circuit for the servo control of the arm to extend also into the cab, since the hydraulic circuit has to connect the arm with the engine and with the related control lever, both mounted on the frame.

To conciliate this aspect with the tilting of the cab, U.S. Pat. No. 5,551,826 provides for the hydraulic and electrical connections, extending between the frame and the cab, to have a suitable length in order not to interfere with the lifting operations of the cab itself.

Also known are earth-moving machines wherein vibration-damping elements are interposed between the cabs and the frame whereon the cabs are mounted (see for instance U.S. Pat. Nos. 5,551,826 and 4,150,474, in which rubber pads are used).

The prior art described above, however, presents a series of drawbacks.

A first drawback is represented by the noise created by the engine and by the hydraulic systems.

Although cabs can be provided with doors and/or windows for better isolating the operator from exterior noise, the reduction of the noise thereby obtained fails to reach a satisfactory level.

This is due to the fact that the bottom of the cab is provided with openings to allow the operator to access the control levers and hence the cab compartment is not fully isolated from the underlying machine.

A second problem is represented by dust, which is a considerable source of annoyance for the operator and which, like noise, penetrates into the cabs through the openings that the cabs present in their bottom in correspondence with the control levers.

A further problem is represented by the vibrations of the machines which are transmitted to the operator.

These vibrations reach considerable intensities and involve the whole machine, cab included, thereby constituting a considerable source of annoyance for the operator.

Not even the interposition of the vibration-damping elements between the cabs and the frames of the machines whereon the cabs are mounted has fully solved this problems.

The control levers, which are fastened directly to the frame, are affected by all vibrations of the machine and transmit them to the operator.

Cabs constructed according to the teachings of U.S. Pat. Nos. 5,520,500 and 5,551,826 are also affected by a further drawbacks relating to the mounting of the cabs on the earth-moving machines during their production.

The construction of the earth-moving machines is effected in an assembly line, and the different parts of the machine are assembled to the frame in the different phases of the assembly line.

Some of these parts, however, in turn comprise multiple pieces and are thus assembled previously elsewhere.

In particular, the cab comprising lateral walls, roof, bottom portion and seat, is first mounted on its own and then positioned and fastened on the frame in correspondence with the control levers.

For earth-moving machines in accordance with U.S. Pat. Nos. 5,520,500 and 5,551,826, the method for assembling the machines is particularly complicated. The arm and the cab cannot be assembled on their own independently of each other and then be mounted on the frame, since the arm must be mounted on the walls of the cab.

SUMMARY OF THE INVENTION

In this situation the technical task constituting the basis for the present invention is to obtain a cab for earth-moving machines that overcomes the aforementioned drawbacks.

Another technical task of the present invention is to obtain a cab for earth-moving machines which provides a good level of reduction in noise, dust and vibration inside the cab during operation.

A further technical task of the present invention is to obtain a cab for earth-moving machines that allows a relatively simple and quick mounting.

The specified technical task and the indicated aims are substantially achieved by a cab for earth-moving machines, as described in the accompanying claims.

BRIEF DESCRIPTION OF THE DRAWINGS

Further features and advantages of the invention shall become more readily apparent from the detailed description of a preferred but not exclusive embodiment of a cab for earth-moving machines illustrated in the accompanying drawings, in which.

DESCRIPTION OF THE PREFERRED EMBODIMENT

Figure 1:
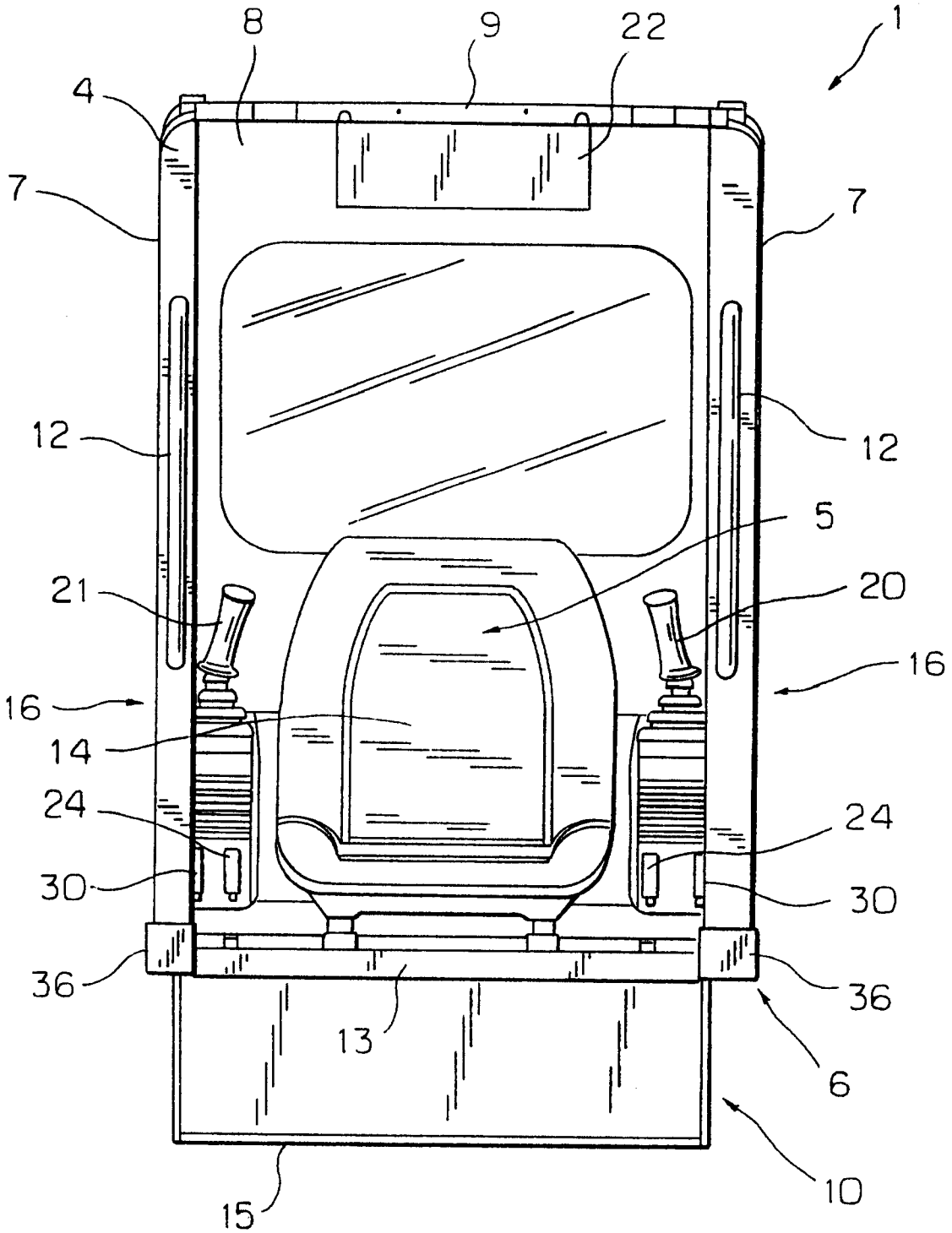
FIG. 1 is a front elevation view of a cab for earth-moving machines in accordance with the present invention.

With reference to the aforesaid figures, the number 1 globally indicates a cab for earth-moving machines in accordance with the present invention.

The cab 1 can be mounted on a frame 2 of an earth-moving machine 3, and comprises a support structure 4 defining a control station 5 for an operator, and fastening means 6 for fastening the support structure 4 to the frame 2.

The support structure 4 is delimited by two side walls 7, by a rear wall 8, by a roof 9 and by a bottom portion 10.

In the illustrated embodiment, the front part 11 of the support structure 4 is open to allow the operator to access the control station 5.

In other embodiments, it can be closed by a door.

At the sides of the front part 11 are provided two handles 12 which the operator can grab to enter the cab 1.

The bottom portion 10 is a surface presenting a raised area 13 bearing a seat 14 for the operator, and a lowered area 15 providing support for the operator's feet, positioned in front of the raised area 13.

The cab 1 also comprises means 16 for controlling the earth-moving machine 3, positioned within the support structure 4 in correspondence with the control station 5.

Said control means 16 can be activated by the operator to control operative organs 18, 19 of the earth-moving machine 3.

Figure 2:
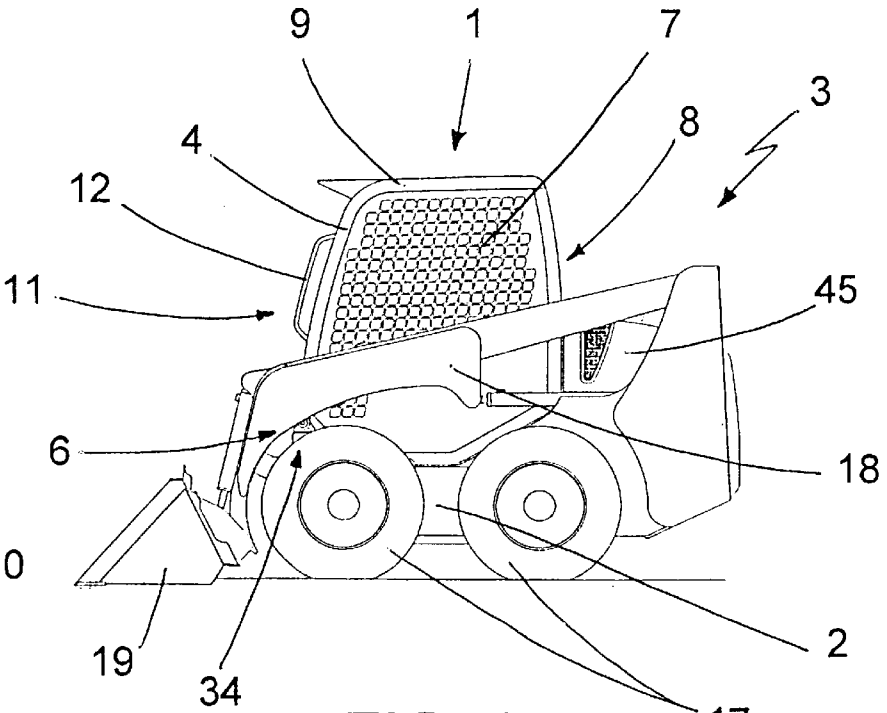
FIG. 2 is a side elevation view of the cab of FIG. 1 mounted on an earth-moving machine.
Figure 3:
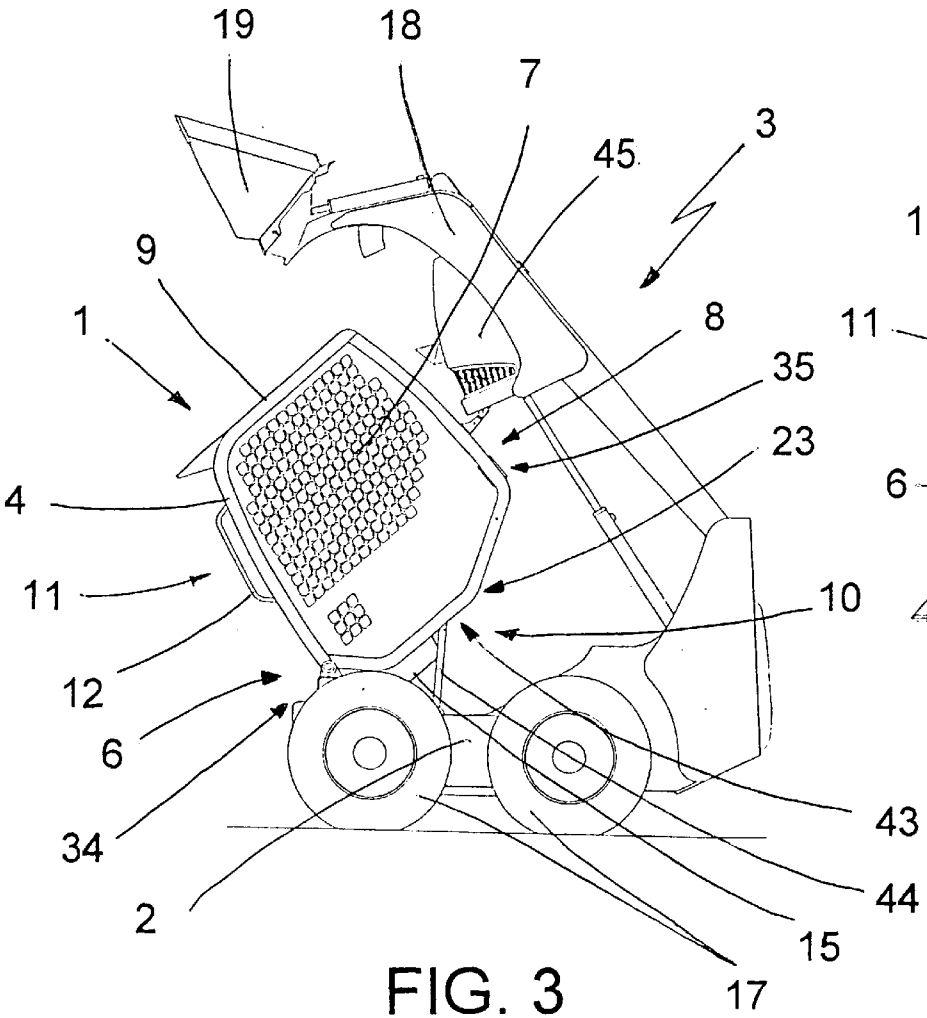
FIG. 3 is the machine of FIG. 2 with the cab in the raised position.

The operative organs 17, 18, 19 comprise, in general, a system for driving the earth-moving machine 3, which acts on wheels 17 (or tracks), and an articulated arm 18 bearing a working tool 19 (in FIGS. 2 and 3 the tool 19 is, for instance, constituted by a shovel).

The control means 16 comprise at least a manipulator 20 mounted on the bottom portion 10 of the cab 1. In particular in the illustrated embodiment the control means 16 comprise, in addition to the manipulator 20, a second manipulator 21. One of the manipulators 20, 21 serves to control the movements of the earth-moving machine 3, whilst the other serves to control the articulated arm 18 bearing the working tool 19.

The two manipulators 20, 21 are mounted at the two sides of the control station 5, in front of the seat 14 in order to be gripped by the operator seated on the seat 14.

The control means 16 further comprise at least a control panel 22 for controlling the operation of the machine 3, mounted in the support structure 4 and oriented towards the control station 5.

FIG. 1 shows the control panel 22 fastened to the roof 9 of the cab 1, but it can also be fastened to one of the side walls 7.

The cab 1 further comprises connecting means 23 to connect operatively the control means 16 to the operative organs 17, 18, 19 of the earth-moving machine 3 and consequently to allow the activation of the machine 3 itself.

Figure 6:
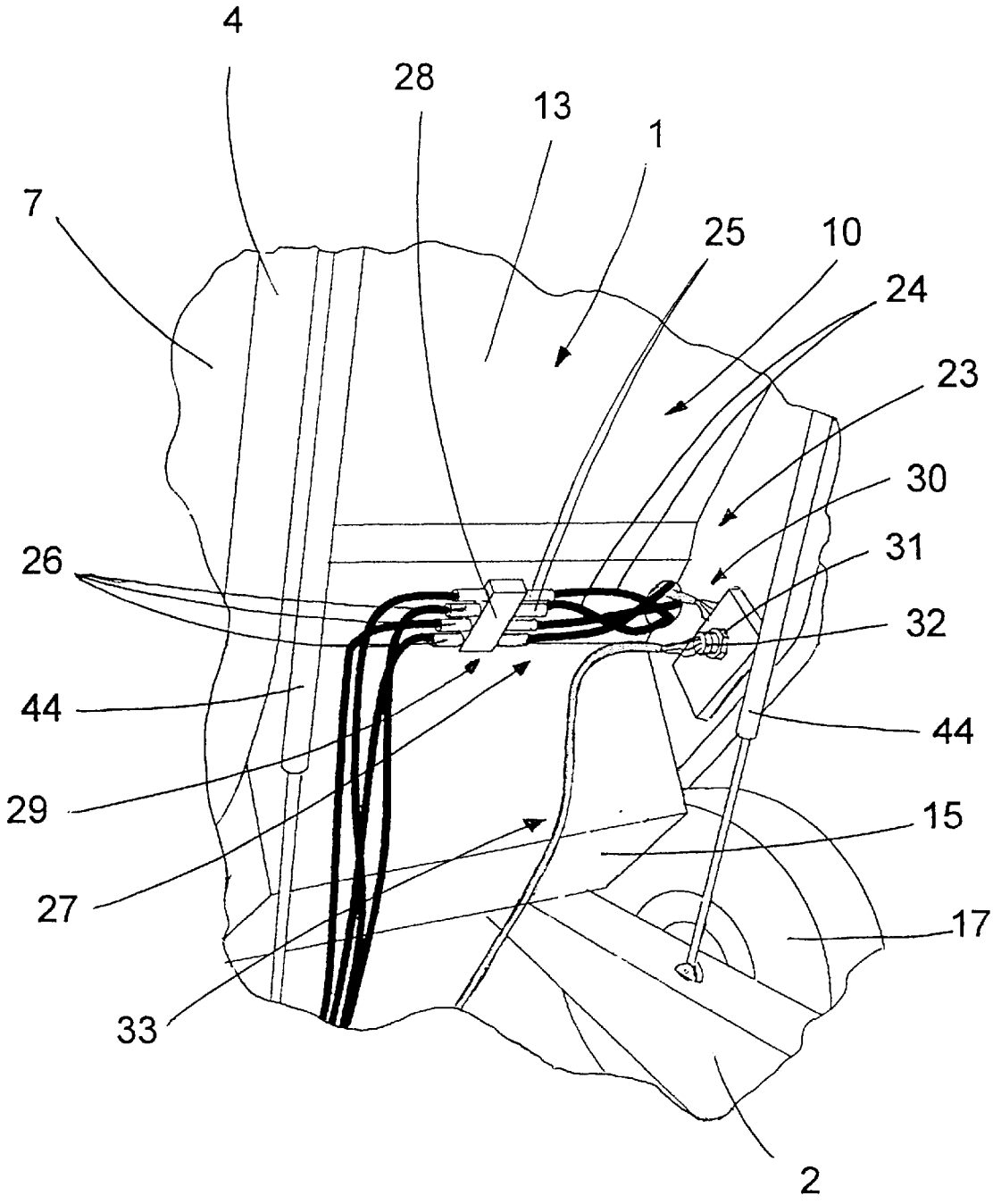
FIG. 6 is a schematic view of the hydraulic and electrical circuits of the cab according to the invention.

The connecting means 23 comprise a plurality of hydraulic conduits 24 connected to the control means 16, as well as a plurality of semi-couplings 25 connected to at least a part of the hydraulic conduits 24 (FIG. 6).

The semi-couplings 25 can be coupled to a corresponding plurality of semi-couplings 26 connected to a hydraulic system of the frame 2 (FIG. 6). Advantageously, in the preferred embodiment, the portion of conduits 24, whereon the plurality of semi-couplings 25 is mounted, is united in at least a bundle 27, and the semi-couplings 25 are grouped in at least a block 28 in correspondence with an end 29 of the bundle 27 (FIG. 6).

The block 28 is then fastened to the support structure 4, in such a way as to facilitate the coupling and uncoupling of the semi-couplings 25, 26. The connecting means 23 further comprise at least an electrical circuit 30 operatively connected to said control means 16 and having at least a terminal 31 connectable to a corresponding terminal 32 of an electrical circuit 33 of the earth-moving machine. The terminal 31 is also fastened to the support structure 4 (FIG. 6).

Advantageously the terminal 31 of the electrical circuit 30 of the cab is an outlet, whilst the terminal 32 of the electrical circuit 33 of the machine is a plug able to be inserted into the outlet.

To the electrical circuit 30 of the connecting means are connected both the manipulators 20, 21 and the control panel 22.

Figure 5:
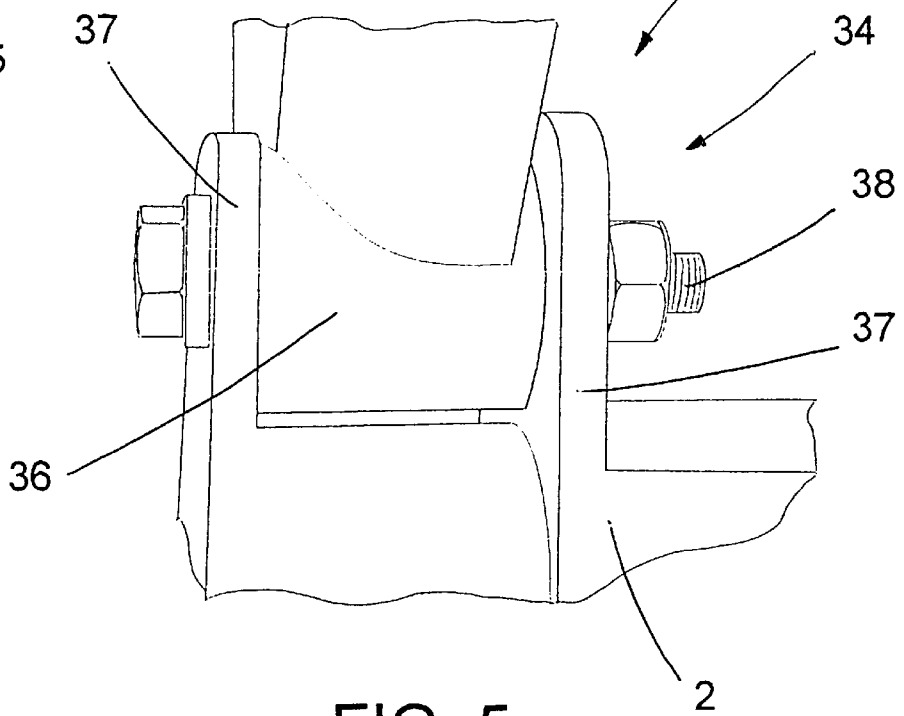
FIG. 5 is a detail of an element for hinging the cab to the earth-moving machine.
Figure 4:
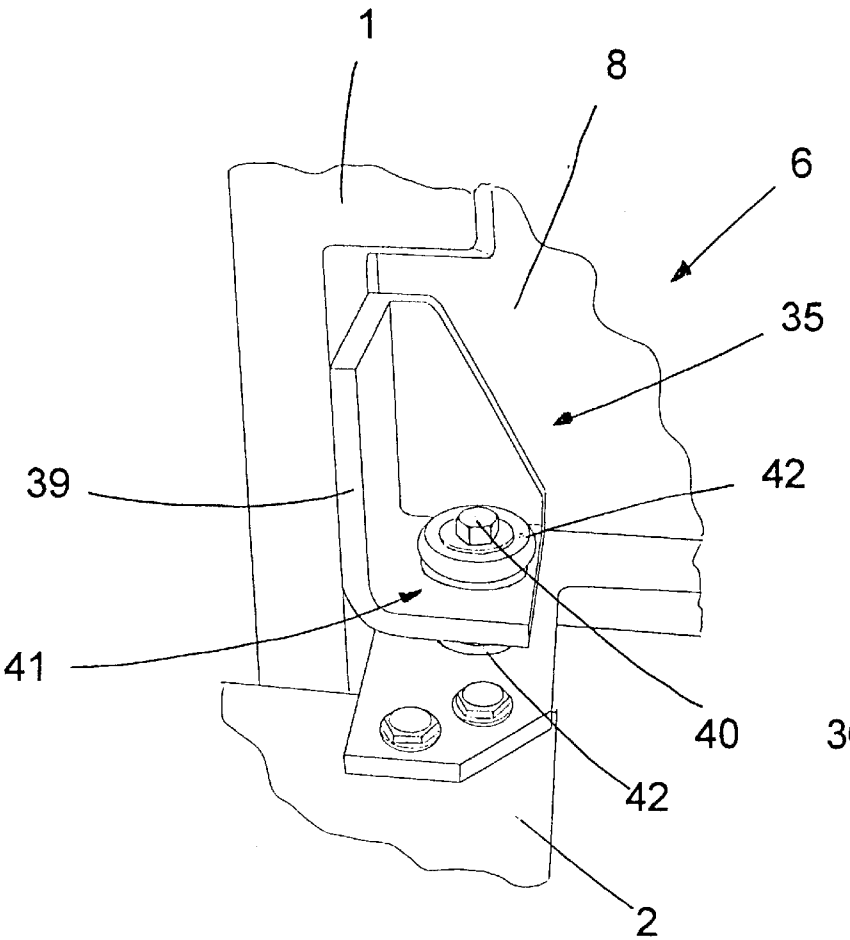
FIG. 4 is a detail of the element for locking the cab to the earth-moving machine.

As regards the fastening means 6, they comprise at least a hinging element 34 (FIG. 5) and at least a locking element 35 (FIG. 4).

The hinging element 34 comprises a tubular element 36 integral with the support structure 4 and able to be inserted between two drilled attachments 37 integral with the frame 2, whereto the tubular element 36 can be fastened by means of a through bolt 38.

In the illustrated embodiment the hinging element 34 is fastened to the front part of the support structure 4, and the tubular element 36 is positioned with its horizontal axis transverse to the cab 1, to allow tilting the cab 1 forward, as shown in FIG. 3.

In particular, the hinging elements 34 are two, both mounted forward of said support structure 4.

The locking element 35 is formed by at least a flange 39 integral with the cab 1 and by at least a bolt 40 passing through said flange 39 and able to be associated to the frame 2 of the earth-moving machine 3 (FIG. 4).

In particular, in the preferred embodiment, the locking element 35 further comprises at least a vibration damping element 41 able to be integrally interposed between the flange 39 and the frame 2.

As FIG. 4 shows, advantageously the vibration damping element 41 comprises two elastic bearings 42, one positioned between the flange 39 and the frame 2, and one between the head of the bolt 40 and the flange 39.

The preferred embodiment is provided with two locking elements 35 fastened posteriorly to the support structure 4.

In alternative embodiments the position of the hinging elements can be exchanged with that of the locking elements so that the cab can be tilted backwards instead of forward, the two solutions being functionally equivalent.

The cab 1 can also comprise at least a coupling point 43 for at least a supporting pneumatic cylinder 44 able to ease the tilting of the cab 1 itself.

Advantageously the cab 1 can also comprise an appendix 45 shaped as a trunk and mounted posteriorly to the support structure 4 and destined to cover the engine of the earth-moving machine 3.

When mounting the cab, the seat 14, the manipulators 20, 21, the control panel 22, the handles 12 and all other useful pieces are mounted on the support structure 4.

The hydraulic conduits 24, with the related semi-couplings 25, are also installed and fastened along with the electrical circuit 30.

If provided, also mounted is the rear appendix 45 destined to cover the engine.

At this point the cab 1 is complete and can be mounted on the earth-moving machine 3, already completed beforehand with all the other parts.

The mounting process comprises the following phases: the cab 1 is positioned on the frame 2, to the frame 2 are fastened the hinging elements 34, the cab 1 is tilted forward and, in the embodiments where they are provided, the pneumatic cylinders 44 are fastened to the cab 1. The hydraulic system of the cab is then connected with that of the frame 2 mutually coupling the semi-couplings 25, 26 and, similarly, the electrical circuit 30 is connected to the electrical circuit 33 of the machine, inserting the plug terminal 32 into the outlet terminal 31.

Lastly, the cab 1 is brought to the operative position (FIG. 2) and the locking elements 35 are fastened to the frame 2.

During the operation of the machine 3, when it is necessary to intervene on its parts located under the cab 1, for maintenance or repair operations, it is sufficient to unlock the locking elements 35 and tilt the cab 1 forward.

The present invention achieves important advantages.

In the first place, the cab has the characteristic of representing a complete module in itself and hence can be assembled also in a different location from the one where the base of the machine is assembled.

At a second time, the cab can be mounted more rapidly onto the machine.

This is a considerable advantage in terms of production, since it allows to delegate construction of the cab also to third parties.

Secondly, the testing of the cab, aimed at verifying the functionality of the control means and the seal of the hydraulic system, can be conducted apart. Thanks to the ease of connection of the systems, with a single machine base available, all cabs can be tested already in the facility where they are assembled.

Moreover, thanks to the ability to tilt the cab, it is possible easily to access the part of the machine underlying the cab for maintenance or repair operations.

If, furthermore, the cab is also provided with the rear appendix, accessibility is maximized because by lifting the cab one also frees access to the engine.

Furthermore, the cab guarantees a considerable reduction in noise, dust and vibration inside the cab itself during operation, thanks to the fact that the bottom portion is much more thoroughly closed than those of the prior art.

It should also be noted that the present invention is easy to construct and that also the cost connected to embodying the invention is not very high.

The invention thus conceived can be subject to numerous modifications and variations, without thereby departing from the scope of the inventive concept characterizing it.

All components can be replaced by technically equivalent elements and in practice, all materials employed, as well as the dimensions, can be any depending on needs.

What is claimed is:

1. A modular cab for earth-moving machines comprising:

a support structure, having a bottom portion, side walls, and a roof, and defining inside a control station for an operator comprising a seat for the operator mounted on said bottom portion, said bottom portion also defining a floor of the cab;

fastening means on the cab for selectively fastening to and removing the cab from a frame of an earth-moving machine;

control means mounted within said support structure and operable by an operator on said seat for controlling operative organs of the earth-moving machine; and connecting means on the cab for operatively connecting said control means to said operative organs of the earth-moving machine including a plurality of hydraulics conduits connected to said control means, a plurality of semi-couplings connected to at least a part of said plurality of hydraulic conduits and able to be coupled to a corresponding plurality of semi-couplings connected to a hydraulic system of the earth-moving machine, to allow the activation of said machine by means of said control means, and at least an electrical circuit operatively connected to said control means and having at least a terminal fixed to the cab connectable to a corresponding terminal of an electrical circuit of the earth-moving machine to connect said electrical circuit of the cab to said electrical circuit of the machine;

wherein the connecting means together with the fastening means permit a testing of the modular cab to verify functionality of the control means and seals of a hydraulic system thereof apart from the earth-moving machine.

2. A cab as claimed in claim 1, wherein said part of conduits whereon said plurality of semi-couplings is mounted is joined in at least a bundle, and said semi-couplings of the cab are grouped in at least a block in correspondence with an end of the bundle, said block being fastened to said support structure.

3. A cab as claimed in claim 1, wherein said control means comprise at least a manipulator mounted inside said support structure and at least a control panel for controlling the operation of the machine operatively connected to said electrical circuit of the cab, mounted in said support structure and oriented towards said control station.

4. A cab as claimed in claim 1, wherein said fastening means comprise at least a hinging element and at least a locking element.

5. A cab as claimed in claim 4, wherein said locking element comprises a flange integral with said support structure and at least a bolt passing through said flange and able to be associated to the frame of the earth-moving machine.

6. A cab as claimed in claim 5, wherein said locking element further comprises at least a vibration damping element able to be integrally interposed between said flange and said frame.

7. A cab as claimed in claim 5, wherein two of said locking elements are mounted posteriorly to said support structure.

8. A cab as claimed in claim 5, wherein said fastening means comprise two of said hinging elements mounted anteriorly on said support structure.

9. An earth moving machine comprising a cab as claimed in claim 5.

10. A cab as claimed in claim 2, wherein said control means comprise at least a manipulator mounted inside said support structure and at least a control panel for controlling the operation of the machine operatively connected to said electrical circuit of the cab, mounted in said support structure and oriented towards said control station.

* * * * *